US006540646B2

(12) United States Patent
Stearns et al.

(10) Patent No.: US 6,540,646 B2
(45) Date of Patent: Apr. 1, 2003

(54) EXERCISE METHODS AND APPARATUS WITH ADJUSTABLE STROKE HANDLEBARS

(76) Inventors: Kenneth W. Stearns, P.O. Box 55912, Houston, TX (US) 77055; Joseph D. Maresh, P.O. Box 645, West Linn, OR (US) 97068-0645

( * ) Notice: Subject to any disclaimer, the term of this patent is extended or adjusted under 35 U.S.C. 154(b) by 80 days.

(21) Appl. No.: 09/788,743

(22) Filed: Feb. 20, 2001

(65) Prior Publication Data

US 2002/0123411 A1 Sep. 5, 2002

Related U.S. Application Data

(63) Continuation-in-part of application No. 09/603,476, filed on Jun. 23, 2000, which is a continuation-in-part of application No. 09/540,061, filed on Mar. 31, 2000.

(51) Int. Cl.[7] ..... A63B 22/04

(52) U.S. Cl. ..... 482/52; 482/51; 482/62

(58) Field of Search ..... 482/51, 52, 53, 482/57, 70, 79, 80, 148, 58–62, 908

(56) References Cited

U.S. PATENT DOCUMENTS

| | | | | | |
|---|---|---|---|---|---|
| 5,836,855 | A | * | 11/1998 | Eschenbach | 482/57 |
| 5,868,650 | A | * | 2/1999 | Wu | 482/62 |
| 6,019,710 | A | * | 2/2000 | Dalebout et al. | 482/70 |
| 6,135,923 | A | * | 10/2000 | Stearns et al. | 482/51 |
| 6,254,514 | B1 | * | 7/2001 | Maresh et al. | 482/52 |
| 6,277,054 | B1 | * | 8/2001 | Kuo | 482/51 |

* cited by examiner

*Primary Examiner*—Stephen R. Crow

(57) ABSTRACT

An exercise apparatus includes a frame, a leg driven member pivotally mounted on the frame, and a handlebar pivotally mounted on the frame and movably connected to the leg driven member. The point of interconnection between the handlebar and the leg driven member is adjustable relative to the pivot axis of the leg driven member. Adjustment toward the pivot axis causes the handlebar stroke to decrease, and conversely, adjustment away from the pivot axis causes the handlebar stroke to increase.

7 Claims, 8 Drawing Sheets

EXERCISE METHODS AND APPARATUS WITH ADJUSTABLE STROKE HANDLEBARS

CROSS-REFERENCE TO RELATED APPLICATIONS

This is a continuation-in-part of U.S. patent application Ser. No. 09/603,476, filed on Jun. 23, 2000, which in turn, is a continuation-in-part of U.S. patent application Ser. No. 09/540,061, filed on Mar. 31, 2000.

FIELD OF THE INVENTION

The present invention relates to exercise methods and apparatus and more particularly, to unique linkage arrangements between arm driven members and leg driven members which are suitable for use on various types of exercise equipment, including elliptical motion exercise machines.

BACKGROUND OF THE INVENTION

Exercise equipment has been designed to facilitate a variety of exercise motions, many of which incorporate both arm and leg movements. Examples of such equipment include elliptical exercise machines (see U.S. Pat. Nos. 5,242,343, 5,423,729, 5,540,637, 5,725,457, 5,792,026, and 5,895,339); free form exercise machines (see U.S. Pat. Nos. 5,290,211, 5,299,993, 5,401,226, and 5,499,956); rider exercise machines (see U.S. Pat. Nos. 2,603,486, 5,695,434, 5,997,446); glider/strider exercise machines (see U.S. Pat. Nos. 4,940,233, 5,795,268); stepper exercise machines (see U.S. Pat. No. 4,934,690); bicycle exercise machines (see U.S. Pat. Nos. 4,188,030 and 4,509,742); and other, miscellaneous exercise machines (see U.S. Pat. Nos. 4,869,494 and 5,039,088). These patents are incorporated herein by reference to show suitable applications for the present invention.

On many such exercise machines, arm driven members and leg driven members are synchronized to facilitate a coordinated "total body" exercise motion. The synchronized motion is considered advantageous to the extent that it makes the equipment relatively easy to use. On the other hand, the perceived quality of exercise tends to exceed the actual quality of the exercise because the arms typically perform very little work. In industry terminology, the arms are described as "along for the ride."

In contrast to the foregoing machines, other exercise machines have been developed to provide independent upper body exercise and lower body exercise. One such machine is the NordicTrack ski machine (an example of which is shown in U.S. Pat. No. 4,728,102). On machines of this type, both the perceived quality of exercise and the actual quality of exercise are relatively more strenuous. However, many people consider ski machines relatively difficult to use, due to the independent or uncoordinated nature of the arm motions and the leg motions.

As compared to the ski machines and other machines with independent motion, another shortcoming of the "synchronized" machines is that the handles are often constrained to move back and forth regardless of whether or not the user wishes to move his arms while moving his legs. In such cases, the handles can be a nuisance and/or a potential source of injury. One known solution to this problem is to alternatively pin the arms to respective leg driven members or the frame (as shown in U.S. Pat. No. 5,792,026). This approach leaves room for improvement because the exercise activity must stop in order to accommodate insertion of the pins, and/or there is a transition interval wherein the position of the arms is not dictated by either the leg driven members or the frame. In this regard, the U.S. Pat. No. 5,792,026 teaches that the arms may be exercised independent of the legs when the pins are entirely removed. However, this alternative mode of operation simply brings users back to the difficulties often associated with the machines having uncoordinated arm and leg movements, and it does not address the requirement that exercise activity cease in order to change between modes. Recognizing that each of the foregoing types of exercise machines suffer certain shortcomings, room for improvement remains with respect to total body exercise equipment.

SUMMARY OF THE INVENTION

The present invention provides unique methods and apparatus for linking a handlebar and a member associated with exercise of a person's leg ("leg member") The present invention may be implemented in various ways to achieve various results. For example, the present invention may be described in terms of constraining an arm driven member to be both (a) synchronized relative to a leg driven member and (b) movable through a variable range of motion while the leg driven member moves through a prescribed range of motion. The present invention may also be described in terms of constraining an arm driven member to be both (a) synchronized relative to a leg driven member and (b) selectively movable (or selectively "stoppable") at any time. A preferred embodiment of the present invention generally includes a frame; a leg member pivotally mounted on the frame; and a handlebar pivotally mounted on the frame. A pivotal portion of the handlebar is linked to the leg member for movement along the leg member. The location of this linked handlebar portion is adjustable relative to the pivot axis of the leg member, and the handlebar's range of motion is a function of a distance between the pivot axis of the leg member and the location of the linked handlebar portion. When the linked handlebar portion is axially aligned with the pivot axis, the handlebar remains stationary during pivoting of the leg member. As the linked handlebar portion is moved away from the pivot axis, the handlebar moves through an increasingly large range of motion during pivoting of the leg member.

Certain benefits may be realized by interconnecting a resistance device and/or a dampening device between the handlebar and either the frame or the leg member. Other benefits may be realized by connecting a powered actuator between the handlebar and either the frame or the leg member. Additional advantages and/or variations of the present invention may become more apparent from the detailed description that follows.

BRIEF DESCRIPTION OF THE DRAWINGS

With reference to the Figures of the Drawing, wherein like numerals represent like parts and assemblies throughout the several views.

DETAILED DESCRIPTION OF THE PREFERRED EMBODIMENT

Figure 1:
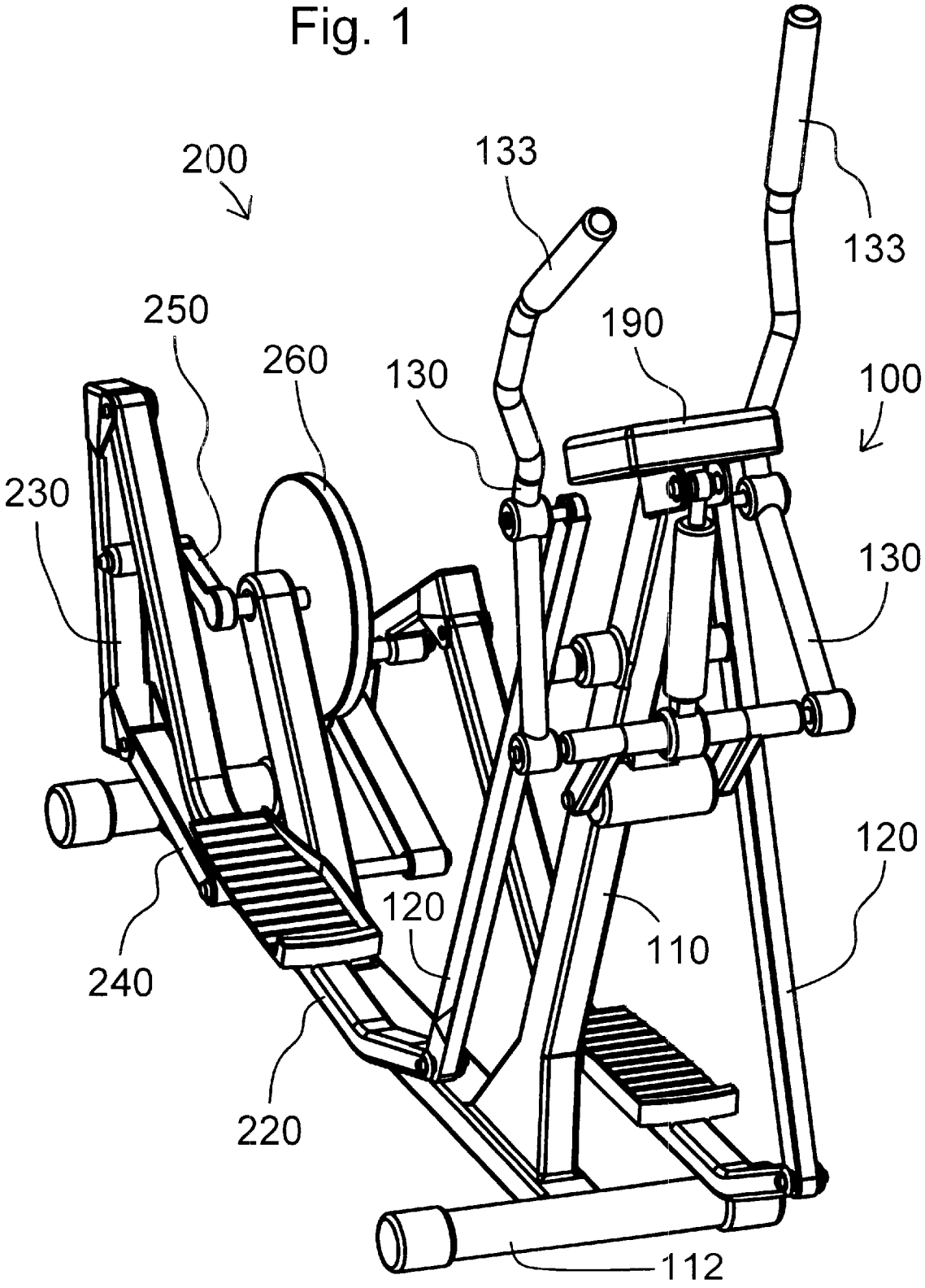
FIG. 1 is a perspective view of a preferred embodiment exercise apparatus constructed according to the principles of the present invention.

A preferred embodiment linkage arrangement constructed according to the principles of the present invention is designated as 100 in FIGS. 1–7. The linkage arrangement 100 is shown on a preferred embodiment exercise apparatus 200, which may be described as an elliptical motion exercise machine that is otherwise similar to an exercise machine disclosed in U.S. Pat. No. 5,895,339 (which is incorporated herein by reference). However, the present invention is not limited to this specific type of exercise machine, nor to any particular category of exercise machine, but rather, is suitable for use on various sorts of exercise equipment. Examples of other suitable applications are mentioned above with reference to other patents that have been incorporated herein by reference.

Both the linkage arrangement 100 and the exercise apparatus 200 are generally symmetrical about a centrally located, vertical plane, with the primary exception being the relative orientation of components disposed on opposite sides of the plane of symmetry. Generally speaking, the "right-hand" components are one hundred and eighty degrees out of phase relative to the "left-hand" components. In any event, like reference numerals are used to designate both the "right-hand" and "left-hand" parts, and when reference is made to one or more parts on only one side of an apparatus, it is to be understood that corresponding part(s) are disposed on the opposite side of the apparatus. Also, parts that are intersected by the plane of symmetry exist individually and thus, do not have any "opposite side" counterparts. Moreover, to the extent that reference is made to forward or rearward portions, it is to be understood that a person could exercise while facing in either direction.

The linkage arrangement 100 may be described with reference to a leg member 120 and a handlebar 130. On the preferred embodiment 100, the leg member 120 is a rocker link that is pivotally connected to frame member 110 at pivot axis PA (shown in FIG. 2), and the handlebar 130 is a rocker link that is pivotally connected to frame member 110 at pivot axis PB (shown in FIG. 2). A distal end 133 of the handlebar 130, opposite the pivot axis PB, is sized and configured for grasping. A base 112 supports the frame member 110 in a stationary, generally vertical orientation relative to an underlying floor surface.

The leg member 120 may be described in terms of upper and lower portions that extend radially away from the leg pivot axis PA. As more fully explained in U.S. Pat. No. 5,895,339, a distal end of the lower portion is pivotally connected to a forward end of a respective foot supporting link 220. An opposite, rearward end of each foot supporting link 220 is pivotally connected to the upper end of a respective connector link 230. An opposite lower end of each connector link 230 is pivotally connected to a respective rocker link 240, which in turn, is pivotally connected to the base 112. An intermediate portion of each connector link 230 is pivotally connected to a respective crank 250, which in turn, is rotatably mounted on the base 112. As a result of this arrangement, an intermediate portion of each foot supporting link 220 moves through a generally elliptical path as each crank 250 rotates and each leg member 120 pivots back and forth.

A flywheel 260 is secured to the crank shaft and constrained to rotate together with the cranks 250. The flywheel 260 adds inertia to the linkage assembly, and any known flywheel resistance mechanism may be connected to the flywheel 260 to add resistance, as well. For example, a drag strap may be disposed about the circumference of the flywheel 260 and maintained in tension as shown in U.S. Pat. No. 4,023,795, which is incorporated herein by reference. Other suitable resistance mechanisms include known electrical braking arrangements and other known types of mechanical braking arrangements. Those skilled in the art will also recognize that the flywheel 260 could be replaced by a relatively large diameter pulley which is linked to a remote flywheel by means of a relatively small diameter pulley.

A channel or race 123 extends lengthwise along at least the upper portion and intermediate portion of the leg member 120. A roller 132 is rotatably mounted on an intermediate portion of the handlebar 130, and is disposed inside the race 123. The leg member 120 is connected to the frame member 110 in a manner that does not obstruct the race 123. The roller 132 and the race 123 cooperate to constrain the intermediate portion of the handlebar 130 to movement along the leg member 120. On the linkage arrangement 100, the diameter of the roller 132 is slightly smaller than the width of the race 123, so that the roller 132 bears against only one side of the race 123 at any given time.

Other arrangements may be provided in lieu of the "play" or "slop" between the roller 132 and the race 123. For example, the roller may be coated with a resilient material having a low friction surface in contact with each side of the race 123. In the alternative, the inside of the race 123 may be lined with a resilient material having opposing, low friction surfaces in contact with the roller 132. Yet another option is to replace the roller 132 with a low friction slide block.

Figure 8:
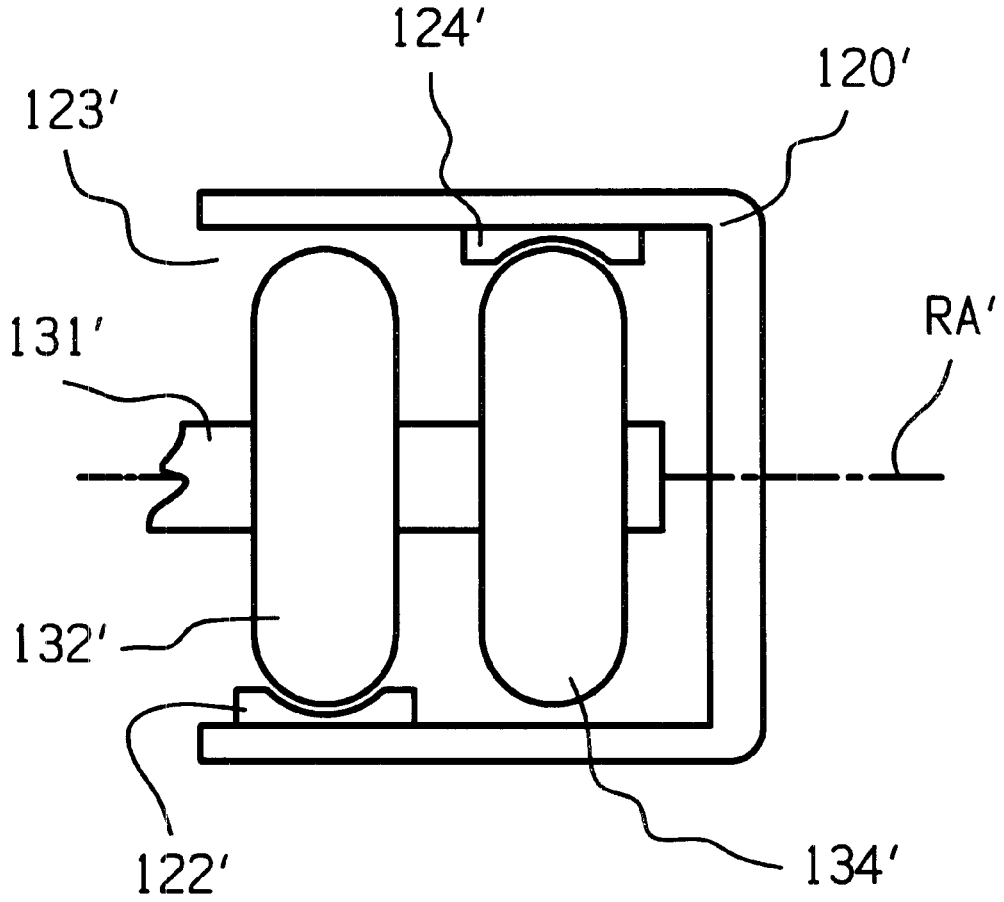
FIG. 8 is an end view of an alternative linkage arrangement suitable for use with the transmission assembly of FIG. 2.

FIG. 8 shows another alternative arrangement suitable for interconnecting the handlebar 130 and the leg member 120. A substitute leg member 120' is provided with a race 123' having a first track (associated with offset 122') and a second track (associated with offset 124'). A shaft 131' is secured to the handlebar 130 and defines a roller axis RA'. A first roller 132' is rotatably mounted on the shaft 131' and bears against the offset 122' associated with the first track. A second roller 134' is rotatably mounted on the shaft 131' and bears against the offset 124' associated with the second track. This arrangement maintains positive, driving contact between the leg member 120' and the handlebar 130 in all phases of operation. The offsets 122' and 124' and the rollers 132' and 134' are shown with complementary convex and concave profiles that may be considered desirable for purposes of maintaining axial alignment. In the absence of such profiles, axial alignment may nonetheless be ensured in various ways, including sufficiently sturdy bearings at the pivot axis PB.

Figure 2:
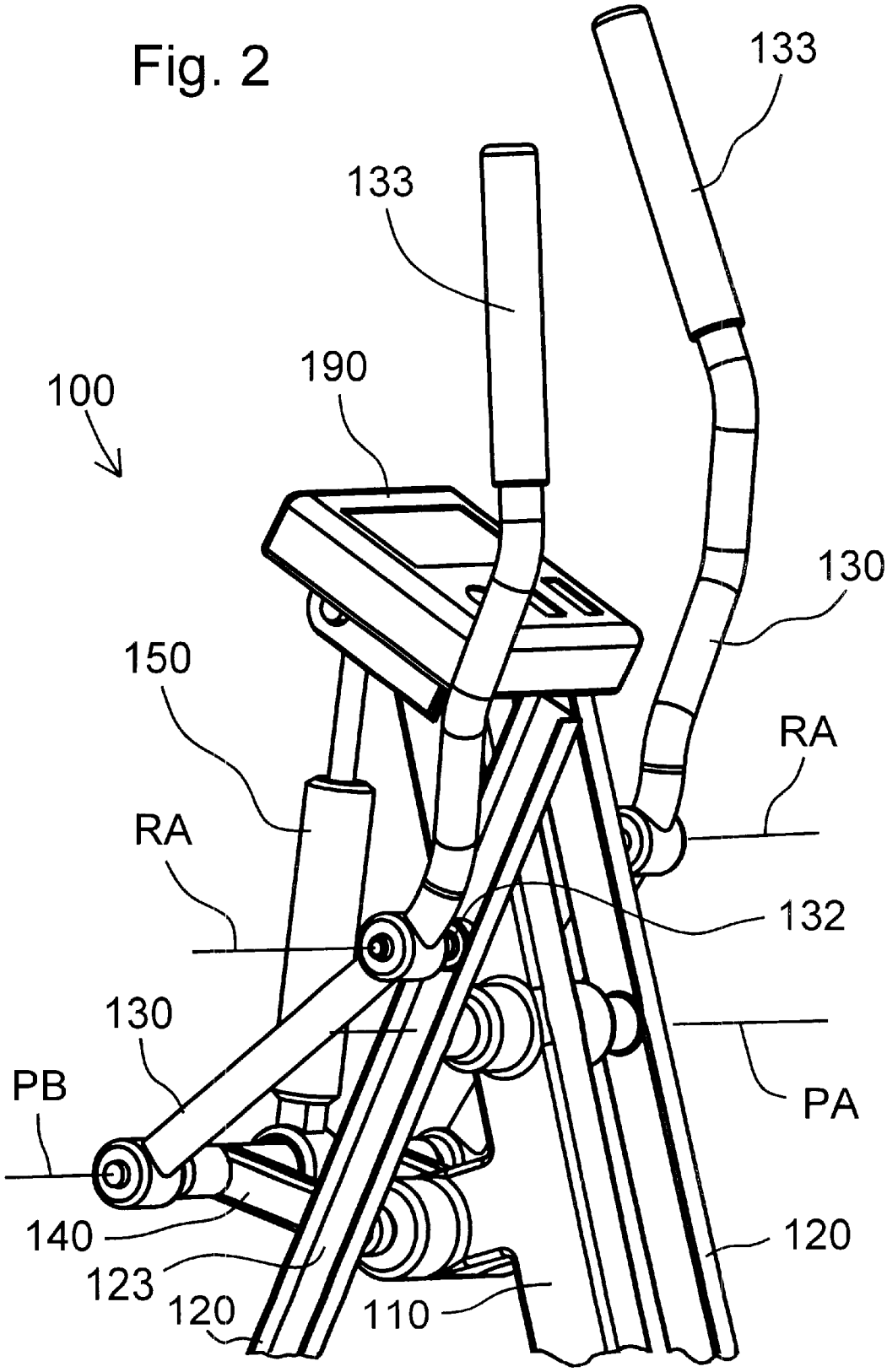
FIG. 2 is a generally opposite perspective view of a preferred embodiment transmission assembly on the exercise apparatus of FIG. 1.
Figure 3:
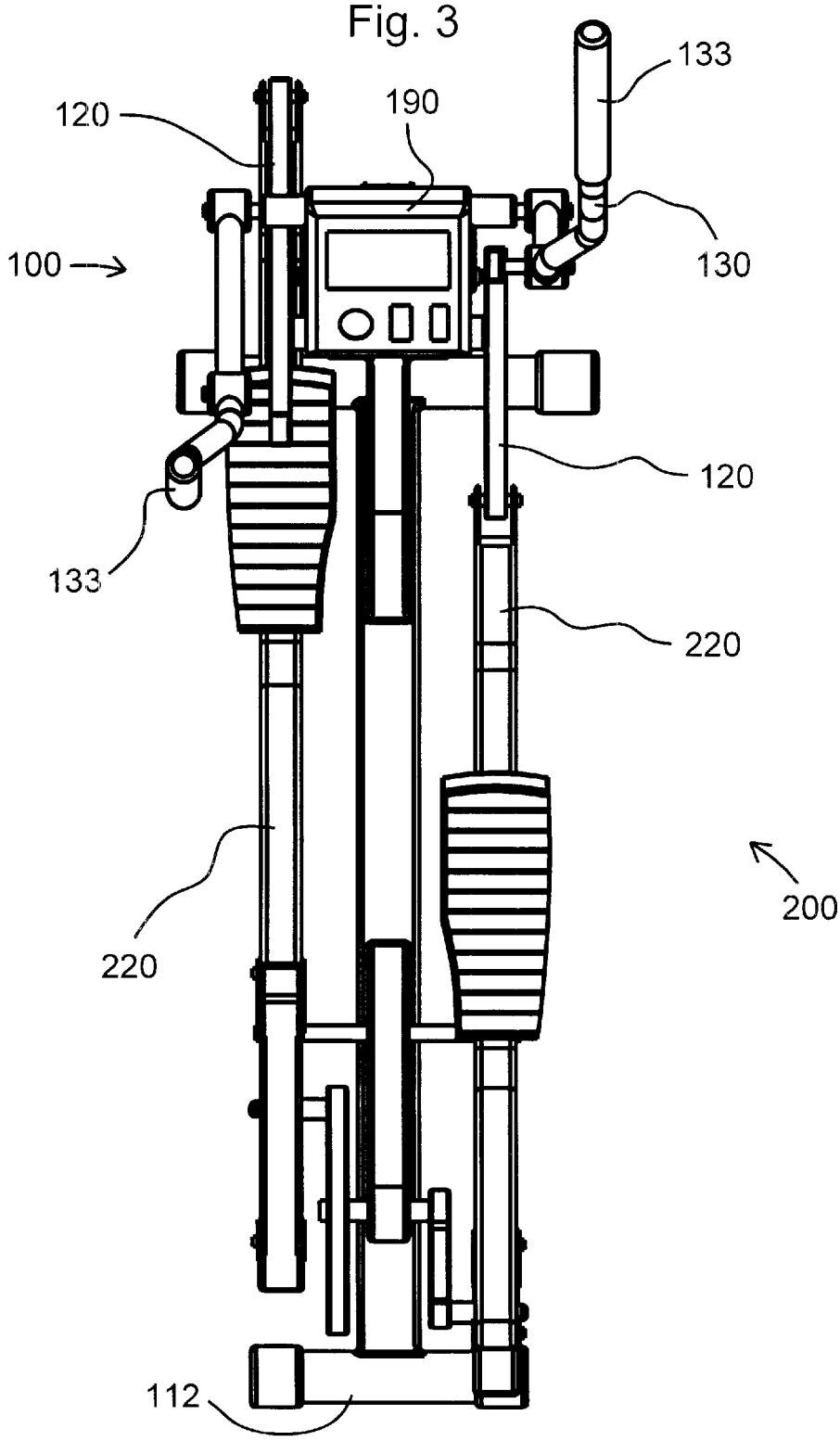
FIG. 3 is a top view of the exercise apparatus of FIG. 1.

With reference back to FIG. 2, a respective roller 132 is provided on each side of the linkage arrangement 100, and rotates about a respective roller axis RA. In FIG. 2, each roller 132 is disposed in the upper portion of a respective leg member 120, at a distance from the leg pivot axis PA. As a result, pivoting of each leg member 120 about the common pivot axis PA is linked to pivoting of a respective roller 132, as well as the remainder of the respective handlebar 130, about the common pivot axis PB.

Figure 4:
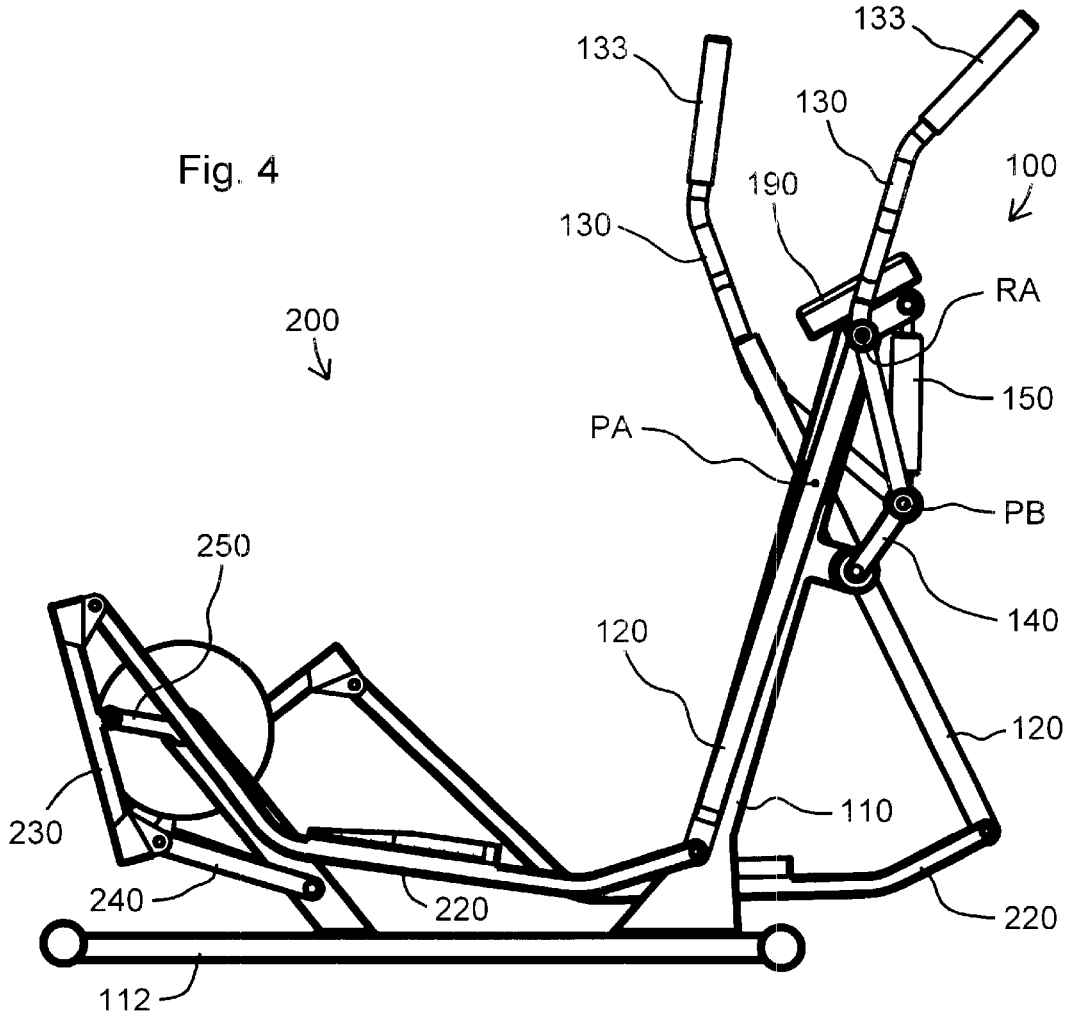
FIG. 4 is a side view of the exercise apparatus of FIG. 1, with the transmission assembly of FIG. 2 configured for handlebar movement through a maximum range of motion.
Figure 5:
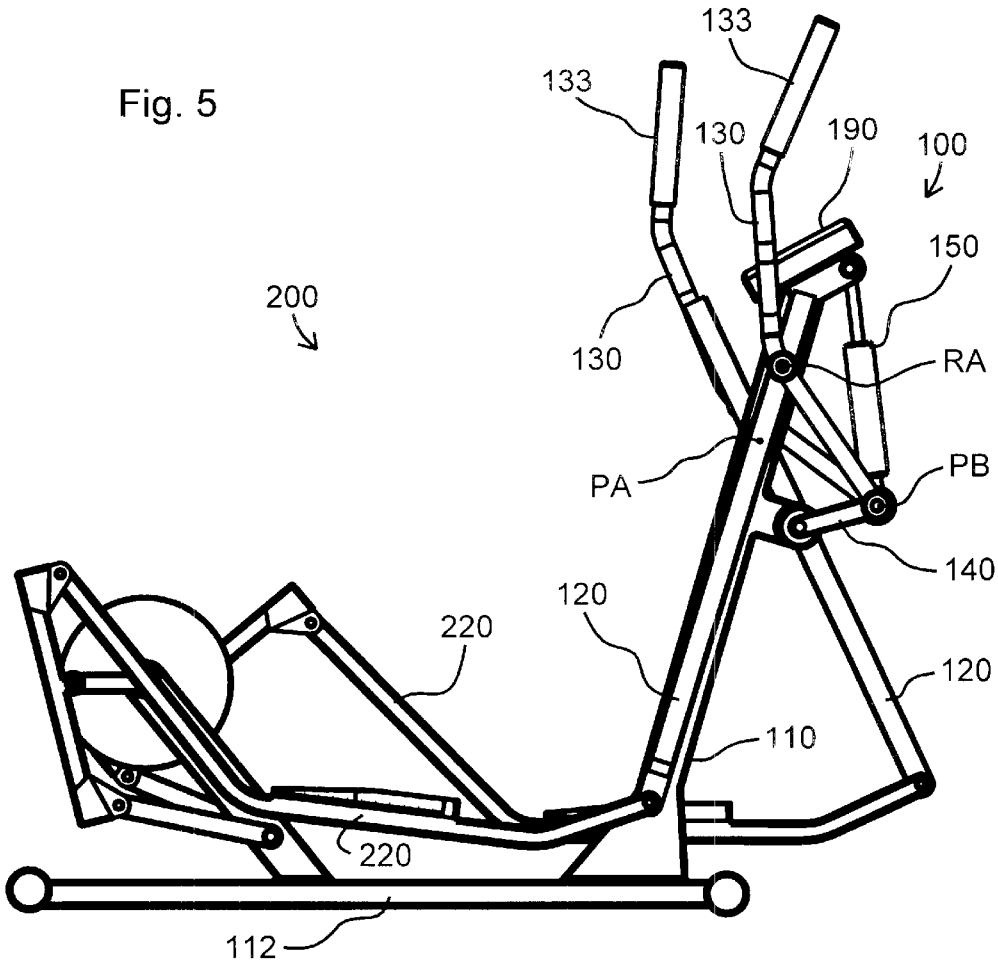
FIG. 5 is a side view of the exercise apparatus of FIG. 1, with the transmission assembly of FIG. 2 configured for handlebar movement through an intermediate range of motion.
Figure 6:
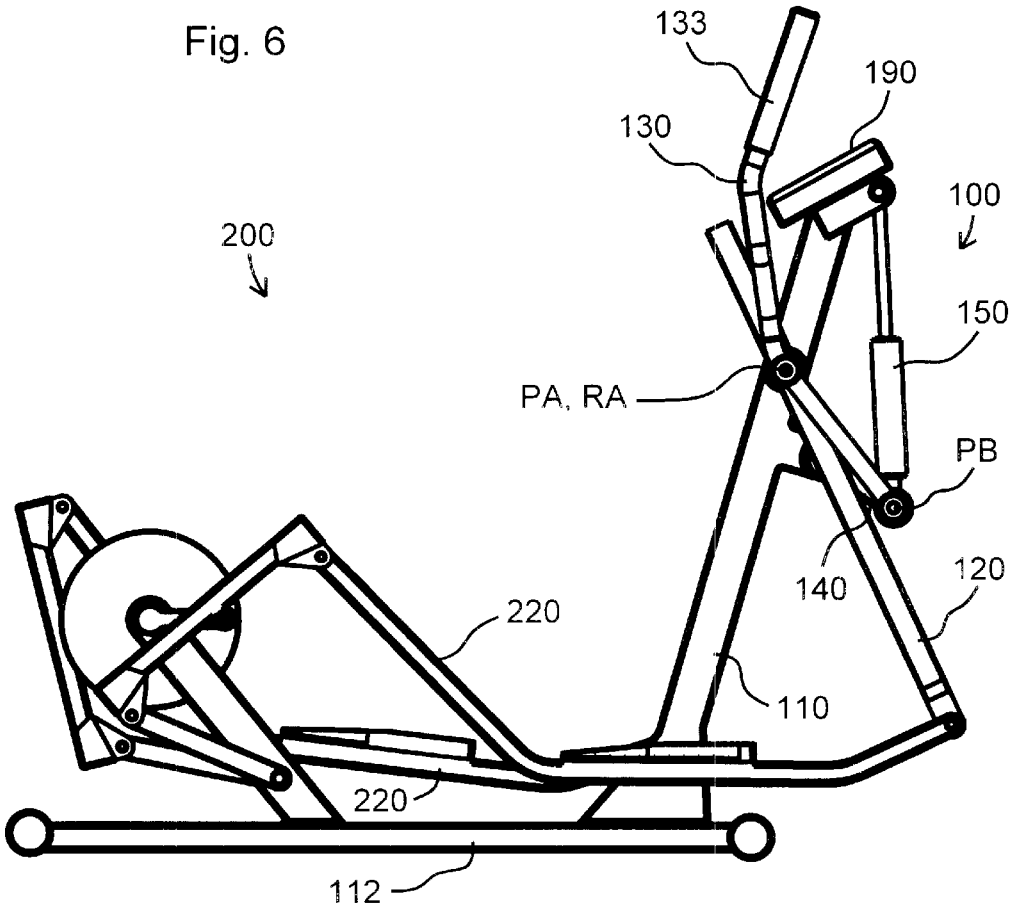
FIG. 6 is a side view of the exercise apparatus of FIG. 1, with the transmission assembly of FIG. 2 configured for zero handlebar movement.
Figure 7:
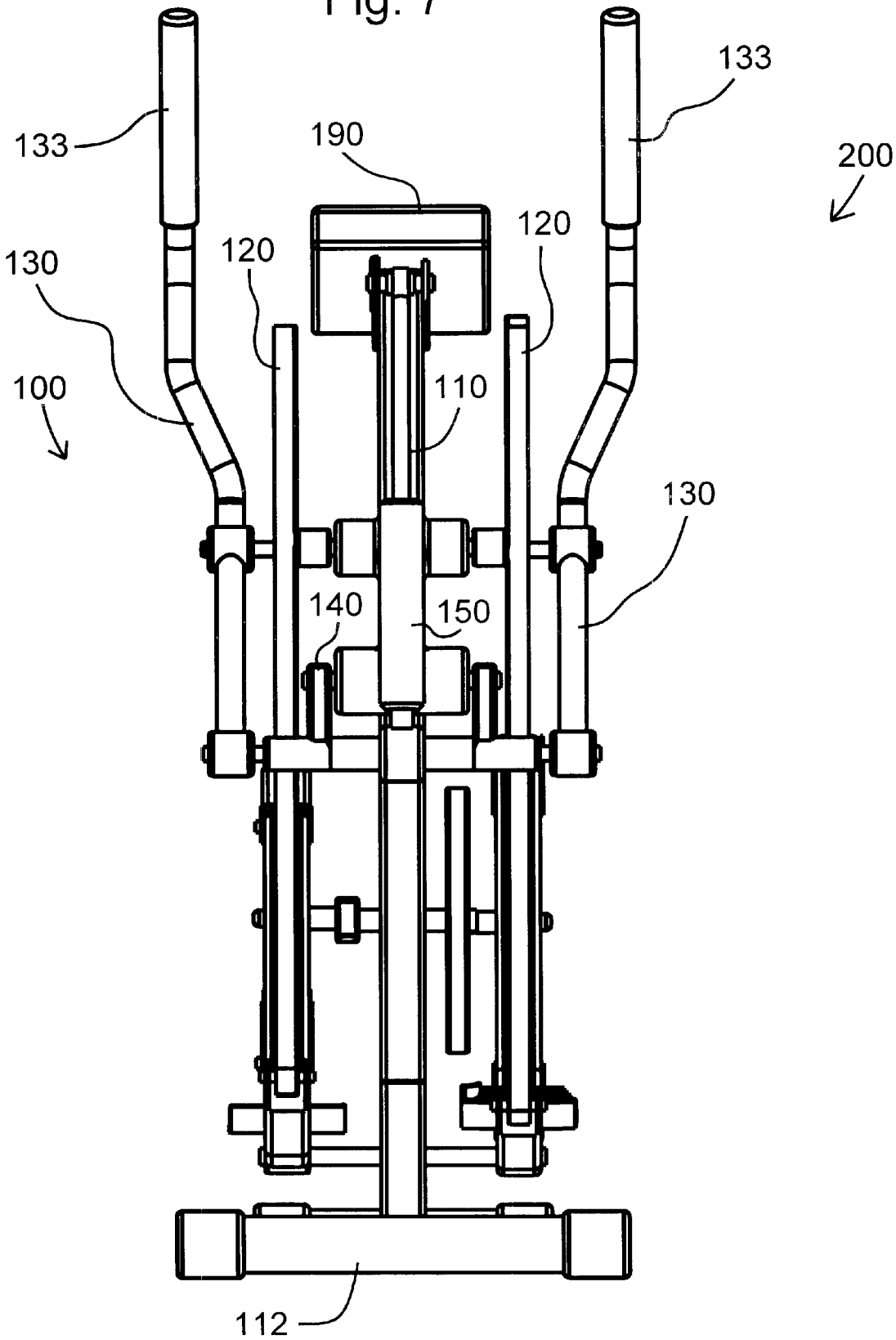
FIG. 7 is a front view of the exercise apparatus of FIG. 6.

The extent or magnitude of the handlebar pivoting is a function of the distance between the roller axes RA and the pivot axis PA. For example, FIG. 4 shows the roller axes RA at a maximum-distance from the pivot axis PA, and the handles 133 at relatively distant extreme positions; FIG. 5 shows the roller axes RA relatively nearer to the pivot axis PA, and the handles 133 at more moderate extreme positions; and FIG. 6 shows the roller axes RA in alignment with the pivot axis PA, and the handles 133 in a common, stationary position. In FIG. 6, the leg members 120 do not impart any "driving" force against respective rollers 132, because the leg members 120 are pivoting about the roller axes RA. Some people may prefer that the handles 133 always move at least a small amount to (a) entice the user to begin arm exercise; and/or (b) convey to the user that the handles 133 are movable.

In order to facilitate adjustment of the roller axes RA relative to the pivot axis PA, the handlebar pivot axis PB is selectively movable relative to the frame member 110. In particular, a brace 140 has a first end pivotally connected to the frame member 110, and an opposite, second end that pivotally supports the handlebars 130 (and is intersected by the pivot axis PB). Also, an adjustable length member 150 has a first end pivotally connected to the frame member 110, and an opposite, second end that is pivotally connected to the second end of the brace 140 (and similarly intersected by the pivot axis PB). On the preferred embodiment 100, the member 150 is a linear actuator that changes length to adjust the position of the pivot axis PB, as well as the position of the roller axes RA. For example, FIG. 4 shows the member 150 in a retracted, relatively short configuration, and FIG. 6 shows the member 150 in an extended, relatively long configuration.

The operation of the leg exercising portion of the machine 200 is the same regardless of how the handlebars 130 are set, and the stroke length of the handlebars 130 may be adjusted without any disruption of the leg exercise activity. Also, the linkage arrangement 100 is such that each leg member 120 and respective handlebar 130 remain synchronized regardless of the latter's range of motion. On the embodiment 100, each handlebar 130 pivots in the same direction as its respective leg member 120. However, those skilled in the art will recognize that each handlebar 130 may be arranged to pivot in, an opposite direction relative to its respective leg member 120 (by moving the roller axis RA beneath the pivot axis PA, for example).

Yet another feature of the preferred embodiment 200 is that handles 133 move downward as their stroke length decreases (see FIG. 6), and they move upward as their stroke length increases (see FIG. 4). This "translational effect" gives the handles 133 a somewhat magical or "high tech" quality from the perspective of the user. It also lends itself to various design options and alternative applications. For example, some people may consider it preferable to design the arrangement 100 so that the handles 133 move forward, additionally or alternatively, as their stroke length decreases.

A user interface or console 190 is mounted on top of the frame member 110. The interface 190 may be configured to perform a variety of functions, including (1) displaying information to the user, including (a) exercise parameters and/or programs, (b) the current parameters and/or currently selected program, (c) the current time, (d) the elapsed exercise time, (e) the current speed of exercise, (f) the average speed of exercise, (g) the number of calories burned during exercise, (h) the simulated distance traveled during exercise, (i) material transmitted over the internet, and/or (j) amounts of work currently being performed by the user's arms and/or legs; and/or (2) allowing the user to (a) select or change the information being viewed, (b) select or change an exercise program, (c) adjust the resistance to exercise (of the arms and/or the legs), (d) adjust the stroke length (of the arms and/or the legs), (e) adjust the orientation of the exercise motion, and/or (f) quickly stop the exercise motion (of the arms and/or the legs).

The linear actuator 150 may be considered desirable because it facilitates automatic and/or remote adjustments to the handlebar stroke length. For example, control signals may be generated by (a) the user pushing a button on the user interface 190; (b) a sensor detecting the presence or absence of the user's hands on the handles 133; (c) a sensor detecting that the user's level of exertion is outside a target range; (d) an automated program; and/or (e) a person other than the user (such as a trainer) who is in communication with the apparatus.

On alternative embodiments, the linear actuator 150 may be replaced by other suitable devices. For example, a pneumatic cylinder may be substituted for the linear actuator 150, and connected to a remote compressor. Another possible alternative is to insert a pin through a hole in a cylinder and any of several "alignable" holes in a rod that telescopes inside the cylinder. On other embodiments, the adjustable length member could be eliminated, and the brace 140 could be adjusted in more direct fashion. In any event, adjustments may be driven by a power supply, performed manually, or performed using work generated during exercise activity. For example, the flywheel 260 and/or the leg members 120 may be tapped to provide the necessary energy.

The interface 190 may be programmed to perform a variety of functions and/or provide a variety of options regarding the linkage arrangement 100. For example, a user may push a button to maintain a desired range of motion for the handlebars 130. The interface 190 may be programmed to maintain the range of motion, but to stop the handlebars 130 in response to a signal from the user or upon detecting that the user has removed his hands from the handles 133. The interface 190 may then resume the desired range of handlebar motion in response to another signal from the user or upon detecting a return of the user's hands to the handles 133.

The handles 133 may be configured to sense arm exertion, via force sensors, for example, in which case the interface 190 may also be programmed to alert the user if arm exercise falls below a target level. The present invention also allows the user to simply "turn off" the arms to (a) facilitate the performance of a secondary task, such as reading a book, taking a drink, or interacting with a computer and/or internet terminal; and/or (b) focus only on lower body exercise, for example.

The present invention also provides various methods which may be implemented in accordance with the embodiments discussed above. Recognizing that this disclosure will enable persons skilled in the art to recognize various embodiments, modifications, and/or applications, the scope of the present invention is to be limited only to the extent of the claims which follow.

What is claimed is:

1. An exercise apparatus, comprising:

a frame designed to rest upon a floor surface, wherein a support is mounted on said frame and selectively movable relative to said frame;

a leg driven member having a first portion pivotally connected to said frame, and a second portion that defines a track; and a handlebar having a first end pivotally connected to said support, a second end sized and configured for grasping, and an intermediate portion movably connected to said track, wherein movement of said second end is a function of where said support is positioned relative to said frame.

2. The exercise apparatus of claim 1, wherein at least one roller is rotatably mounted to said intermediate portion of said handlebar.

3. The exercise apparatus of claim 1, wherein an adjustable length member is movably interconnected between said support and said frame.

4. The exercise apparatus of claim 1, wherein said adjustable length member changes length in response to a control signal.

5. The exercise apparatus of claim 4, wherein said control signal is generated whenever a person releases said second end of said handlebar.

6. An exercise apparatus, comprising:

a frame designed to rest upon a floor surface;

a leg driven member having a first portion pivotally connected to said frame, and a second portion that defines a track;

a handlebar having a first end pivotally connected to said frame, a second end sized and configured for grasping, and an intermediate portion movably connected to said track; and a means for repositioning said first end of said handlebar relative to said frame, and thereby adjusting to what extent said second end of said handlebar pivots relative to said frame.

7. An exercise apparatus, comprising:

a frame designed to rest upon a floor surface;

a support movably mounted on said frame;

a left leg driven member and a right leg driven member, wherein each said leg driven member has a first portion pivotally connected to said frame, and a second portion that defines a track;

a left handlebar and a right handlebar, wherein each said handlebar has a first end pivotally connected to said support, a second end sized and configured for grasping, and an intermediate portion movably connected to a respective track;

an adjustable length member movably interconnected between said support and said frame, wherein said adjustable length member adjusts in length to control to what extent said second end of said handlebar pivots relative to said frame.

* * * * *